US005643035A

United States Patent [19]

Freese et al.

[11] Patent Number: 5,643,035

[45] Date of Patent: Jul. 1, 1997

[54] BUBBLE PRODUCING DEVICE HAVING A ROTATABLE TURBINE WHEEL WITH PIN MEMBERS

[75] Inventors: Theodore B. Freese, Westminster, Colo.; Michael J. Nickel, Cincinnati, Ohio; James S. Panzarella, Denver, Colo.

[73] Assignee: Gerry Baby Products Company, Thornton, Colo.

[21] Appl. No.: 554,975

[22] Filed: Nov. 13, 1995

[51] Int. Cl.[6] ..... A63H 33/28

[52] U.S. Cl. ..... 446/15; 415/124; 416/188

[58] Field of Search ..... 446/15, 16, 17, 446/18, 19, 20, 21, 153, 475; 415/124; 416/76, 188, 185

[56] References Cited

U.S. PATENT DOCUMENTS

| | | | |
|---|---|---|---|
| 1,384,593 | 7/1921 | Brumford | 416/76 |
| 2,547,825 | 4/1951 | King . | |
| 2,662,686 | 12/1953 | Wuerfel | 416/185 |
| 2,736,988 | 3/1956 | Fisher . | |
| 2,794,292 | 6/1957 | Noble . | |
| 2,890,028 | 6/1959 | Lauffer | 416/76 |
| 2,987,847 | 6/1961 | Jones . | |
| 3,145,912 | 8/1964 | Weis | 415/124 |
| 3,708,909 | 1/1973 | Winston . | |
| 4,044,496 | 8/1977 | Jernstrom . | |
| 4,184,284 | 1/1980 | Rogahn . | |
| 4,347,682 | 9/1982 | Hackell . | |
| 4,576,582 | 3/1986 | Panzarella . | |
| 5,102,381 | 4/1992 | Danielak et al. . | |
| 5,137,424 | 8/1992 | Daniel | 416/185 X |
| 5,269,715 | 12/1993 | Silveria et al. | 446/16 |

FOREIGN PATENT DOCUMENTS

| | | | |
|---|---|---|---|
| 1189954 | 4/1965 | Germany | 416/188 |
| 2535878 | 2/1977 | Germany | 416/188 |
| 406086871 | 3/1994 | Japan | 446/15 |

OTHER PUBLICATIONS

Kusan, Tubba Bubbles, Playthings, Feb. 1982.

*Primary Examiner*—Robert A. Hafer
*Assistant Examiner*—D. Neal Muir

[57] ABSTRACT

A device for producing bubbles is disclosed including a housing having an entry port and an exit port, where a chamber is defined therein in flow communication with the entry and exit ports. A drive shaft is located within the housing chamber with a turbine wheel mounted to the drive shaft in a rotatable manner. The turbine wheel includes a plurality of pin members extending therefrom and a crank arm is provided for rotating the turbine wheel. Accordingly, water and bubble solution entering the housing chamber through the entry port is mixed with air to produce bubbles in the housing chamber which are encouraged to flow through the exit port. The entry port is oriented substantially perpendicular to the rotation of the turbine wheel and the exit port is oriented substantially in line with the rotation of the turbine wheel.

15 Claims, 3 Drawing Sheets

BUBBLE PRODUCING DEVICE HAVING A ROTATABLE TURBINE WHEEL WITH PIN MEMBERS

BACKGROUND OF THE INVENTION

1. Field of the Invention

The present invention relates to a device for producing bubbles and, more particularly, to a bubble producing device having a rotatable turbine wheel with pin members extending therefrom which mixes air, water and bubble solution to produce bubbles.

2. Description of Related Art

Numerous types and designs of toys have been developed in the prior art which make or produce bubbles when bubble making liquids or solutions are utilized therewith. The oldest and simplest design is the wire or plastic frame having an enclosed portion, such as a circle, which is dipped into bubble making liquid. Bubbles are then produced by a person blowing onto such enclosed portion so that bubbles are caused to form on the opposite side thereof. One disadvantage of this technique is that the user must place his mouth on or about the apparatus. This becomes a health concern, particularly when there are many users of the apparatus, since it promotes the spread of germs. There have been other bubble making toys developed which do not necessitate the user personally blowing on it. However, most of these devices are complex and expensive to produce and still involve the blowing of air through bubble solution. Examples of these devices are discussed in U.S. Pat. No. 4,347,682, U.S. Pat. No. 4,044,496, and U.S. Pat. No. 3,708,909.

It will also be understood that it is desirable for bubble making devices to be usable by a child during a bath. Accordingly, it would be advantageous if the bubble making toy is able to utilize bath water which includes diluted bubble bath or liquid therein. One example of such a bubble toy is disclosed in U.S. Pat. No. 5,269,715, which is designed to be used in clear water, soapy water or bubble bath water. This soap bubble making apparatus has a bubble wheel with a plurality of vanes thereon which rotates within the toy housing. Rotation of the bubble wheel causes an aeration and mixes air, water and bubble solution supplied thereto, which produces bubbles that are created by and escape through bubble openings in the housing. While the soap bubble making apparatus of U.S. Pat. No. 5,269,715 is adequate for it's intended purpose, it has been found that the use of vanes on the bubble wheel do not maximize bubble production within the apparatus housing, but appears to be a compromise so that other bubbles may be created in housing openings.

Therefore, it would be desirable if a bubble producing device or toy would be created that maximizes bubble production within the toy housing without having to rely upon openings in the housing to further create such bubbles. It would also be highly desirable if such bubble producing device could be utilized within a bath or water environment.

SUMMARY OF THE INVENTION

In accordance with one aspect of the present invention, a device for producing bubbles is disclosed including a housing having an entry port and an exit port, where a chamber is defined therein in flow communication with the entry and exit ports. A drive shaft is located within the housing chamber with a turbine wheel mounted to the drive shaft in a rotatable manner. The turbine wheel includes a plurality of pin members extending therefrom and means are provided for rotating the turbine wheel. Accordingly, water and bubble solution entering the housing chamber through the entry port is mixed with air to produce bubbles in the housing chamber which are encouraged to flow through the exit port. The entry port is oriented substantially perpendicular to the rotation of the turbine wheel and the exit port is oriented substantially in line with the rotation of the turbine wheel.

Accordingly, an object of the present invention is to provide a bubble producing device that maximizes bubble production.

Another object of the present invention is to provide a bubble producing device that can be utilized in a water or bath environment.

Still another object of the present invention is to provide a bubble producing device that is easy to operate.

Yet another object of the present invention is to provide a bubble producing device that uses new and recycled bubble solution.

Another object of the present invention is to provide a bubble producing device that is safe to operate.

Still another object of the present invention is to provide a bubble producing device that is aesthetically pleasing.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
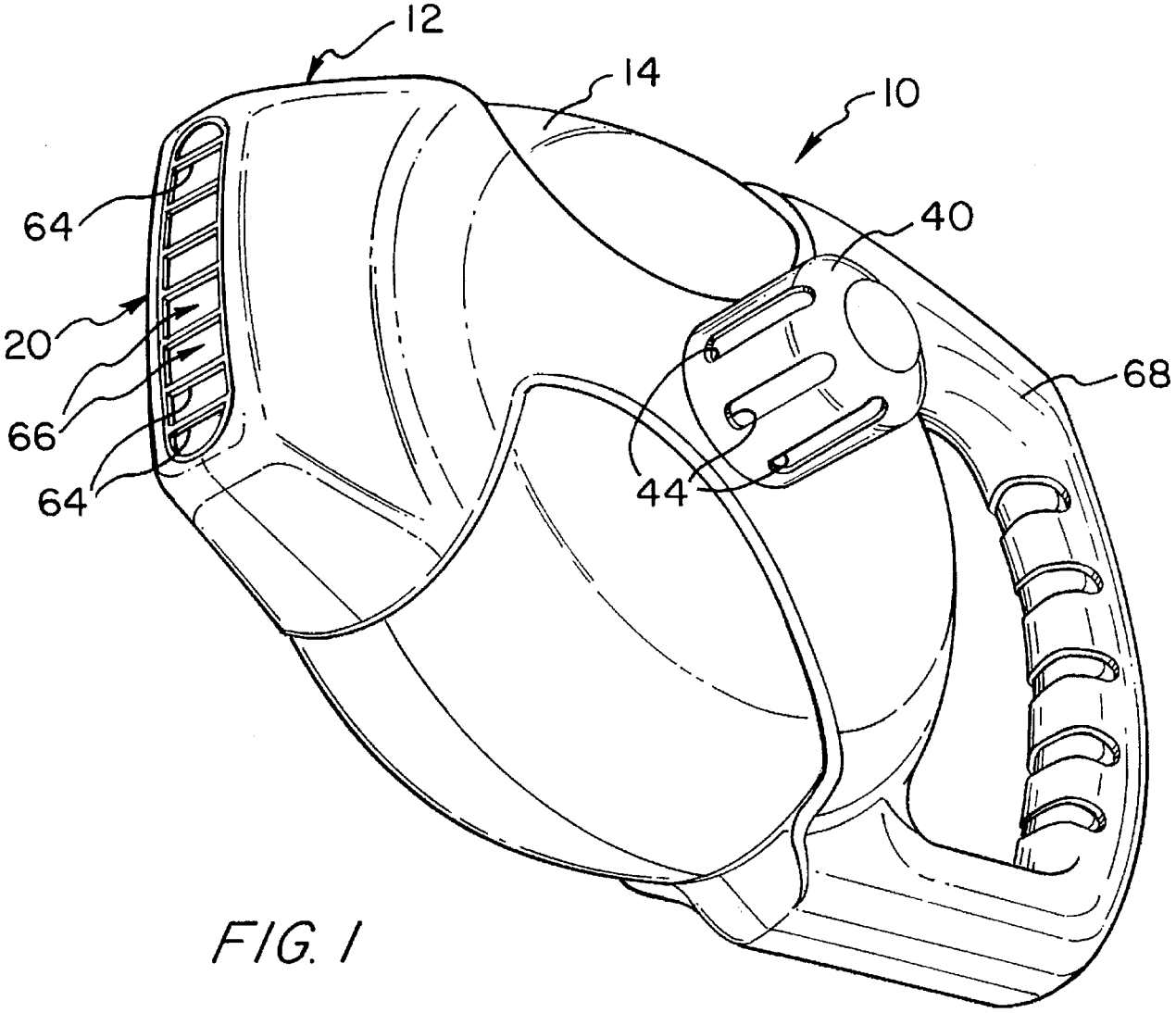
FIG. 1 is a perspective view of the bubble producing device of the present invention.
Figure 2:
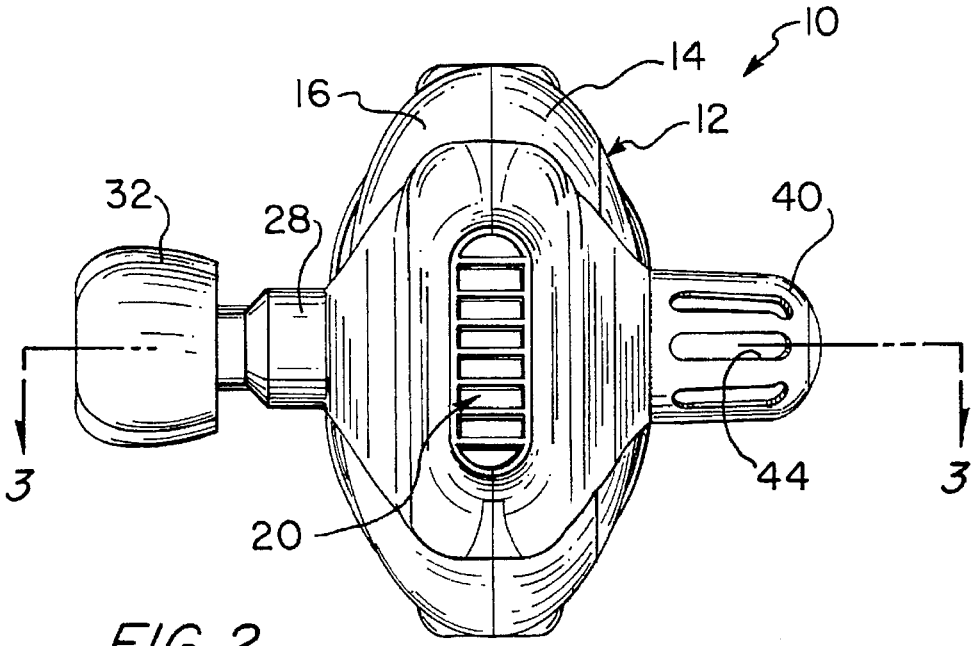
FIG. 2 is a left side view of the bubble producing device depicted in FIG. 1.

Referring now to the drawing in detail, wherein identical numerals indicate the same elements throughout the figures, FIG. 1 depicts a bubble producing device 10 which may be utilized in clear water, soapy water or bubble bath water such as within bath water or another water environment. Thus, it is preferred that all parts of bubble producing device 10 be made of plastic in order to ensure safety of the user and allow bubble producing device 10 to remain free of rust and other water induced conditions.

More specifically, bubble producing device 10 includes a housing 12 which is preferably formed of a first shell-like half 14 being mated with a second shell-like half 16. It will be noted that each half of housing 12 is preferably formed separately such as by injection molding or the like. Housing 12 includes an entry port 18 and exit port 20 (see FIG. 3), with a housing chamber 22 being defined within housing 12 which is in flow communication with entry and exit ports 18 and 20.

Figure 3:
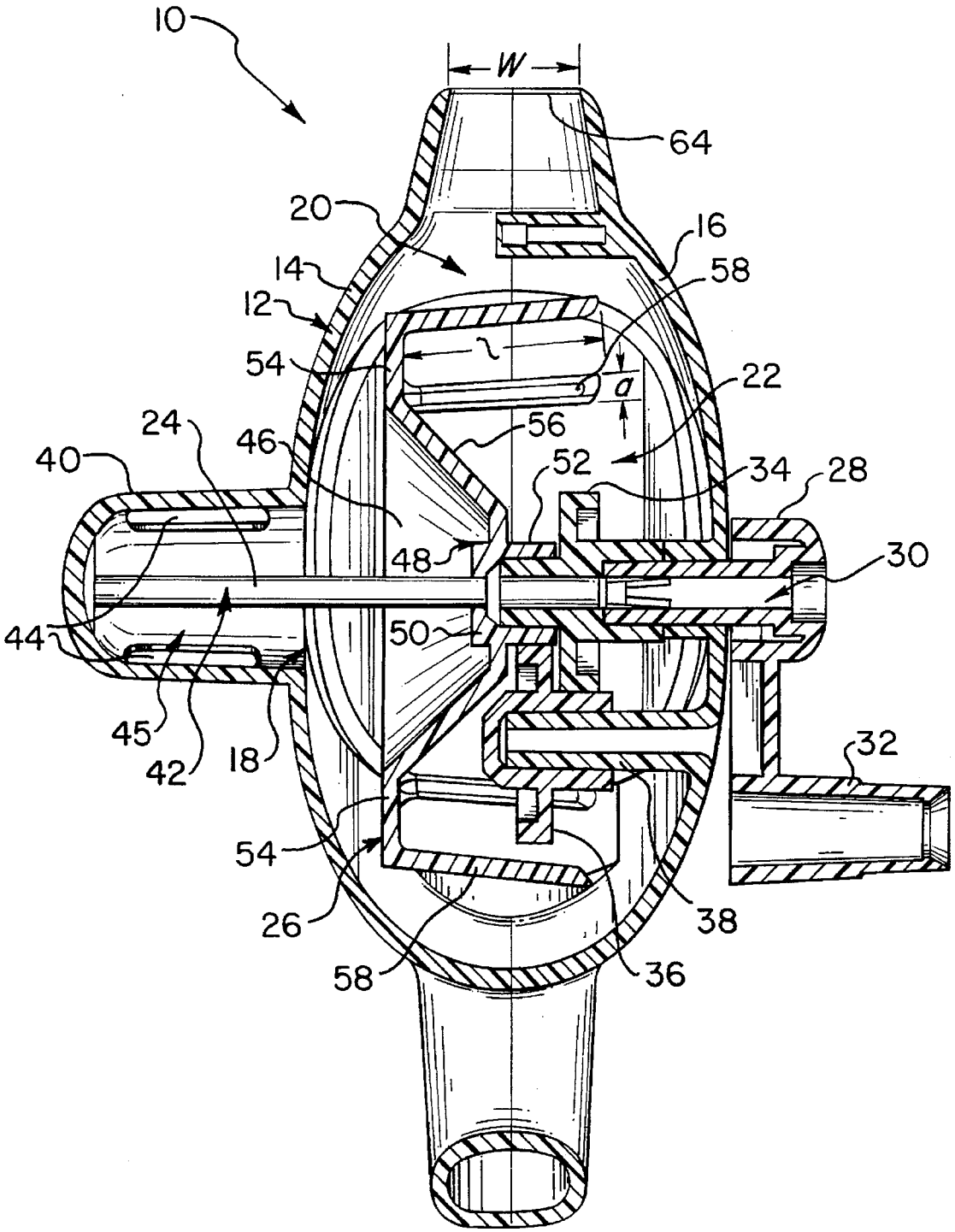
FIG. 3 is a cross-sectional view of the bubble producing device taken along lines 3—3 in FIG. 2.

As seen in FIG. 3, bubble producing device 10 includes a drive shaft 24 located within housing chamber 22. A turbine wheel, designated generally by the numeral 26, is mounted in a rotatable manner to drive shaft 24 so that mixing of air occurs with water and bubble solution entering chamber 22 through entry port 18. It will be noted that turbine wheel 26 is positioned within housing chamber 22 so that entry port 18 preferably is oriented substantially perpendicular to the rotation of turbine wheel 26 and exit port 20 is oriented substantially in alignment with rotation of turbine wheel 26.

In order to rotate turbine wheel 26, a crank arm 28 is provided which retains a first end 30 of drive shaft 24. A handle 32 is then utilized to cause rotation of crank arm 28. While only one gearing mechanism is needed to provide a mechanical connection between crank arm 28 and turbine wheel 26 so that turbine wheel 26 is able to rotate about drive shaft 24 when crank arm 28 is turned, it is preferred that a driving gear 34 be mechanically coupled to crank arm 28 and an intermediate gear 36 be mechanically coupled to driving gear 34 and turbine wheel 26. It will be understood that intermediate gear 36 generally will have a smaller size than driving gear 34 so that turbine wheel 26 rotates faster than driving gear 34 and crank arm 28 (i.e., it completes more than one rotation for each rotation of crank arm 28). It will be seen that intermediate gear 36 is retained upon a shaft member 38 extending inwardly from housing 12 into housing chamber 22, preferably on a side of drive shaft 24 opposite exit port 20.

With respect to entry port 18, it will be seen that a knob 40 will be provided that extends outwardly from housing 12 opposite crank arm 28. Knob 40 serves to retain a second end 42 of drive shaft 24 and includes a plurality of elongated apertures 44 formed therein so as to allow flow communication from outside knob 40 into a reservoir 45 within knob 40. It will be understood that reservoir 45 is, in turn, in flow communication with a bubble forming area 46 within housing chamber 22 by means of entry port 18.

Turbine wheel 26 includes a central portion 48 which is adjacent drive shaft 24 at a first end 50 and mechanically coupled to intermediate gear 36 at a second end 52. Turbine wheel 26 further includes an end portion 54, which is substantially ring-shaped (best seen in FIG. 4). An intermediate portion 56 connects central portion 48 and end portion 54 of turbine wheel 26. It will be seen from FIG. 3 that intermediate portion 56 of turbine wheel 26 preferably extends diagonally across housing chamber 22 to end portion 54 of turbine wheel 26 and is therefore substantially frusto-conical in shape. In this way, a bubble forming area 46 of housing chamber 22 is located adjacent to and within the conical area defined by intermediate portion 56 of turbine wheel 26. Moreover, this configuration of turbine wheel 26 permits end portion 54 of turbine wheel 26 to be positioned toward one side of housing chamber 22.

Figure 4:
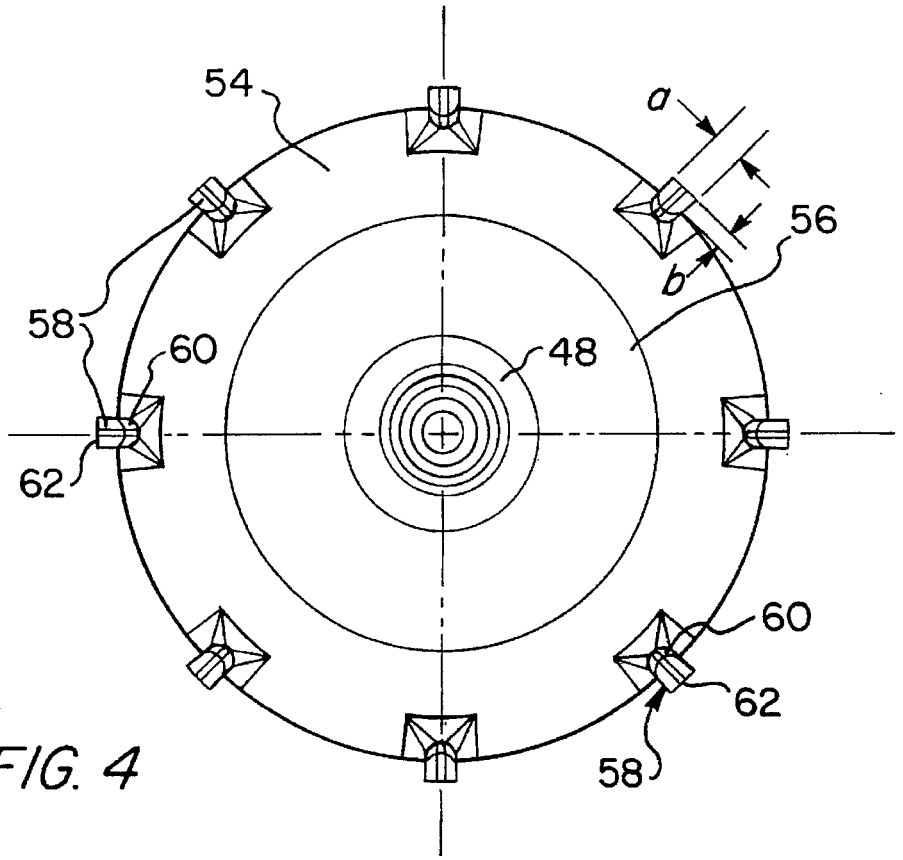
FIG. 4 is a side view of the turbine wheel depicted in FIG. 3.

Most importantly, as seen in FIGS. 3 and 4, turbine wheel 26 includes a plurality of elongated, slender pin members 58 which extend from end portion 54 thereof. It will be seen that pin members 58 are preferably oriented substantially parallel to drive shaft 24 and have a longitudinal length l approximating the width w of exit port 20. As may be seen in FIG. 4, the pin members 58 have a tangential width "a" oriented tangentially relative to the turbine wheel 26 and a radial width "b" oriented radially relative to the turbine wheel 26. The tangential width "a" is substantially equal to the radial width "b" wherein the pin members 58 have an elongated, slender and finger-like profile. More specifically, pin members 58 preferably each have a rounded inner surface 60 and a flat or planar outer surface 62 (see FIG. 4), and a longitudinal length l approximately 5–7 times the tangential width "a" thereof (see FIG. 3). In order to promote the desired mixing action of air with water and bubble solution entering housing chamber 22 by entry port 18, it will be seen that rotation of turbine wheel 26, and more particularly pin members 58, provide aeration so that production of bubbles thereby is maximized. Pin members 58 arc to be contrasted with other mixing members of the prior art, such as the vanes located on the bubble wheel of U.S. Pat. No. 5,269,715, because the surface area of pin members 58 is greatly reduced from the vanes which allows them to produce a more efficient swirling action.

Although not required to form bubbles, exit port 20 preferably includes a plurality of spaced bar members 64 positioned thereacross in order to prevent a user from sticking a finger or other article within the housing chamber 22. Accordingly, it will be seen in FIG. 1 that a plurality of corresponding exit passages 66 are formed between adjacent bar members 64.

It will also be noted that a handle 68 may be attached to housing 12 in order to permit greater control of bubble producing device 10. Handle 68 may be a portion of first and second shell-like halves 14 and 16 of housing 12, or may be a separate item attached to housing 12 which can also assist in the mating of such housing halves 14 and 16.

Having shown and described the preferred embodiment of the present invention, further adaptations of the bubble producing device can be accomplished by appropriate modifications by one ordinary skill in the art without departing from the scope of the invention.

We claim:

1. A device for producing bubbles, comprising:

(a) a housing having an entry port and an exit port, wherein a chamber is defined therein in flow communication with said entry and exit ports;

(b) a drive shaft located within said housing chamber;

(c) a turbine wheel plate mounted in a rotatable manner to said drive shaft, said turbine wheel plate having a circumference, and said turbine wheel plate including a plurality of elongated, slender pin members oriented essentially perpendicular to said turbine wheel plate and extending in free-standing relation along said circumference; and (d) rotating means for rotating said turbine wheel plate, said rotating means including a hand crank, and a gear drive between said hand crank and said drive shaft to provide a mechanical advantage for rotating said turbine wheel plate faster than rotation of said hand crank;

wherein water and bubble solution entering said housing chamber through said entry port is mixed with air to produce bubbles in said housing chamber which flow through said exit port.

2. The bubble producing device of claim 1, wherein said pin members are oriented substantially parallel to said drive shaft.

3. The bubble producing device of claim 2, wherein said pin members have a longitudinal length extending substantially parallel to said drive shaft and approximating a width of said housing exit port.

4. The bubble producing device of claim 1, said turbine wheel plate further comprising:

(a) a central portion located in concentric fashion to said drive shaft;

(b) an end portion oriented substantial perpendicular to said drive shaft; and (c) an intermediate portion connecting said central portion and said end portion;

wherein said pin members extend from a surface of said end portion.

5. The bubble producing device of claim 1, said housing entry port further comprising a knob member extending from said housing, said knob member retaining an end of said drive shaft and including at least one aperture for the receipt of water and bubble solution into a reservoir, wherein said reservoir is in flow communication with said housing chamber.

6. The bubble producing device of claim 1, wherein said stank handle retains an end of said drive shaft.

7. The bubble producing device of claim 1, said housing exit port including a plurality of bar members extending thereacross to form a plurality of exit passages for said bubbles to flow through.

8. The bubble producing device of claim 1, said housing further comprising a pair of shell-like members mated together.

9. The bubble producing device of claim 4, said pin members having a rounded inner surface and a flat outer surface.

10. The bubble producing device of claim 1, wherein said entry port is oriented substantially perpendicular to rotation of said turbine wheel plate.

11. The bubble producing device of claim 1, wherein said exit port is oriented substantially in line with rotation of said turbine wheel plate.

12. The bubble producing device of claim 6, wherein said gear drive comprises:

(a) a first gear connected to said hand crank; and (b) a second gear connected to said first gear and said turbine wheel plate, said second gear being smaller than said first gear;

wherein said turbine wheel plate is rotated faster than said first gear.

13. The bubble producing device of claim 4, said intermediate portion of said turbine wheel plate being frustoconical in shape, wherein a bubble producing area is defined adjacent said intermediate portion.

14. The bubble producing device of claim 1, wherein said pin members have a tangential width oriented tangentially relative to said turbine wheel plate and a radial width oriented radially relative to said turbine wheel plate, wherein said tangential width is substantially equal to said radial width.

15. The bubble producing device of claim 14, wherein said pin members have a longitudinal length extending substantially parallel to said drive shaft, said longitudinal length being approximately 5–7 times said tangential width of said pin members.

* * * * *